United States Patent [19]

Oikawa

[11] 4,013,384

[45] Mar. 22, 1977

[54] MAGNETICALLY DRIVEN CENTRIFUGAL PUMP AND MEANS PROVIDING COOLING FLUID FLOW

[75] Inventor: Kunihiro Oikawa, Niiza, Japan

[73] Assignee: Iwaki Co., Ltd., Tokyo, Japan

[22] Filed: Mar. 7, 1975

[21] Appl. No.: 556,325

[30] Foreign Application Priority Data

July 18, 1974 Japan ..... 49-85377[U]
July 18, 1974 Japan ..... 49-85378[U]

[52] U.S. Cl. ..... 417/368; 417/370; 417/420; 415/112; 415/115

[51] Int. Cl.[2] ..... F04B 35/04; F04B 39/06; F01D 25/12

[58] Field of Search ..... 417/420, 368–370, 417/DIG. 1, 372, 357; 415/115, 53, 111, 112

[56] References Cited

UNITED STATES PATENTS

| | | | |
|---|---|---|---|
| 2,636,665 | 4/1953 | Lombard | 415/115 |
| 3,220,350 | 11/1965 | White | 417/370 |
| 3,238,878 | 3/1966 | Martin | 417/420 |
| 3,288,073 | 11/1966 | Pezzillo | 417/370 |
| 3,332,252 | 7/1967 | Miller et al. | 417/420 |
| 3,411,450 | 11/1968 | Clifton | 417/420 |
| 3,420,184 | 1/1969 | Englesberg | 417/420 |
| 3,520,642 | 7/1970 | Fulton | 417/420 |

*Primary Examiner*—Carlton R. Croyle
*Assistant Examiner*—Thomas I. Ross

[57] ABSTRACT

A magnetically driven centrifugal pump comprising an impeller rotatably supported in a casing by means of a hollow shaft; passage means including the through hole of said hollow shaft for conducting part of a fluid so as to cool said shaft; and an auxiliary pump for forcing the fluid through said passage means, thereby preventing the shaft from being thermally seized or damaged even when the discharge pressure of the pump suddenly drops.

7 Claims, 8 Drawing Figures

FIG. 3
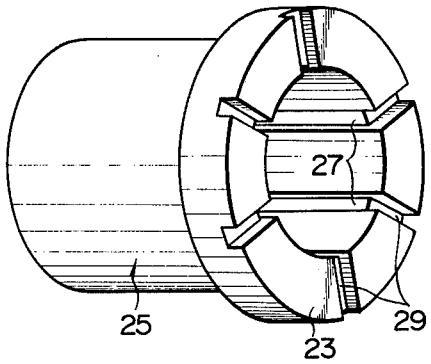
FIG. 4
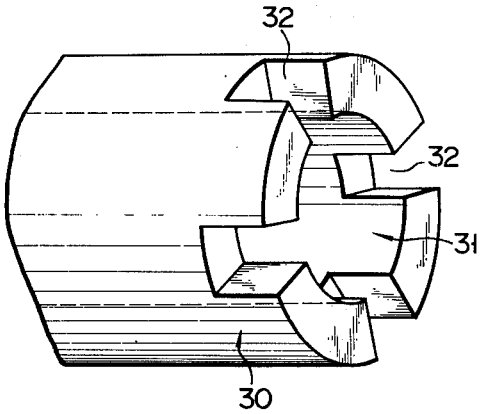
FIG. 5
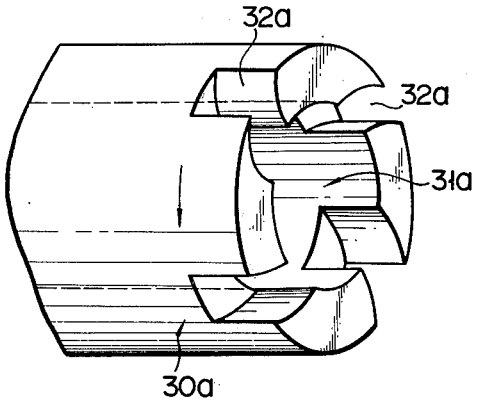
FIG. 7
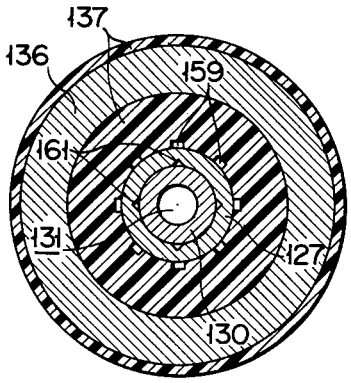
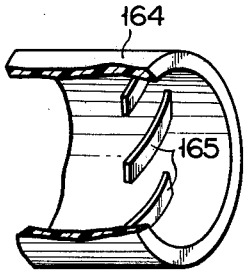
FIG. 8

MAGNETICALLY DRIVEN CENTRIFUGAL PUMP AND MEANS PROVIDING COOLING FLUID FLOW

This invention relates to a magnetically driven centrifugal pump. This type of centrifugal pump generally comprises an impeller rotatably supported in a hermetically sealed casing by supporting means including a shaft; a first magnet fixed to the impeller; an actuating member provided outside of the casing and designed to rotate concentrically with the impeller; a second magnet fixed to the actuating member; drive means for operating the actuating member; and passage means for conducting part of a fluid being pumped to the proximity of the supporting means for cooling. During operation, the actuating member magnetically rotates the impeller to force a fluid from the inlet to the outlet. Part of the fluid flows through the passage means by the discharge pressure of the centrifugal pump to cool and lubricate the supporting means.

With the above-mentioned type of centrifugal pump, the drive means and impeller are fully shut off from each other, offering the advantage of prominently elevating the sealing effect, but is accompanied with the drawback that the supporting means, particularly the shaft is inefficiently cooled. To describe in greater detail, the shaft is generally solid and fails to be fully cooled even in normal operation. Where the discharge pressure of the pump happens to drop sharply, the fluid ceases to run through the passage means, failing fully to absorb friction heat built up in the shaft. As the result, the bearing plane of the shaft is sometimes seized and, in extreme cases, damaged by thermal stress.

It is accordingly the object of this invention to provide a magnetically driven centrifugal pump which attains the full cooling of the shaft even when the discharge pressure of the pump happens to fall noticeably.

With the centrifugal pump of this invention, the shaft is bored with a through hole constituting part of the passage means and further, auxiliary pumping means is provided to force a fluid through at least part of the passage means.

The above-mentioned arrangement enables a cooling fluid to pass through the hollow shadt fully to cool said shaft and its bearing plane, and also the auxiliary pumping means always to conduct the cooling fluid through the passage means, so long as the impeller is kept rotating, even when the discharge pressure of the pump considerably decreases, thereby preventing the supporting means, particularly the shaft from being seized or damaged.

According to an embodiment of this invention, the shaft is fixed to the impeller and rotatably supported on the inner walls of the casing by means of bearing. That end face of the shaft which is located downstream of the through hole is provided with at least one radially extending groove. This groove constitutes part of the auxiliary pumping means to send forward a cooling fluid by a centrifugal force when the shaft rotates with the impeller.

According to another embodiment of the invention, the shaft is fixed to the inner walls of the casing and the impeller is rotatably supported on said shaft by means of bearing. In this case, a gap forming part of the passage means is defined between the shaft and impeller. The auxiliary pumping means consists of at least one blade rotatable with the impeller to carry a cooling fluid through said gap.

This invention can be more fully understood from the following detailed description when taken in conjunction with the accompanying drawings, in which:

FIG. 3 is an enlarged oblique view of the bearing ring used in FIG. 1;

FIG. 4 is an enlarged oblique view of the pumping grooves formed in the end face of the hollow shaft of FIG. 1;

FIG. 5 is an enlarged oblique view of a modification of the pumping grooves shown in FIG. 4;

FIG. 7 is a cross sectional view on line 7–7 of FIG. 6; and

FIG. 8 is a fractional enlarged sectional view of the cylindrical member of FIG. 6 and axial flow type blades fitted therein.

Figure 1:
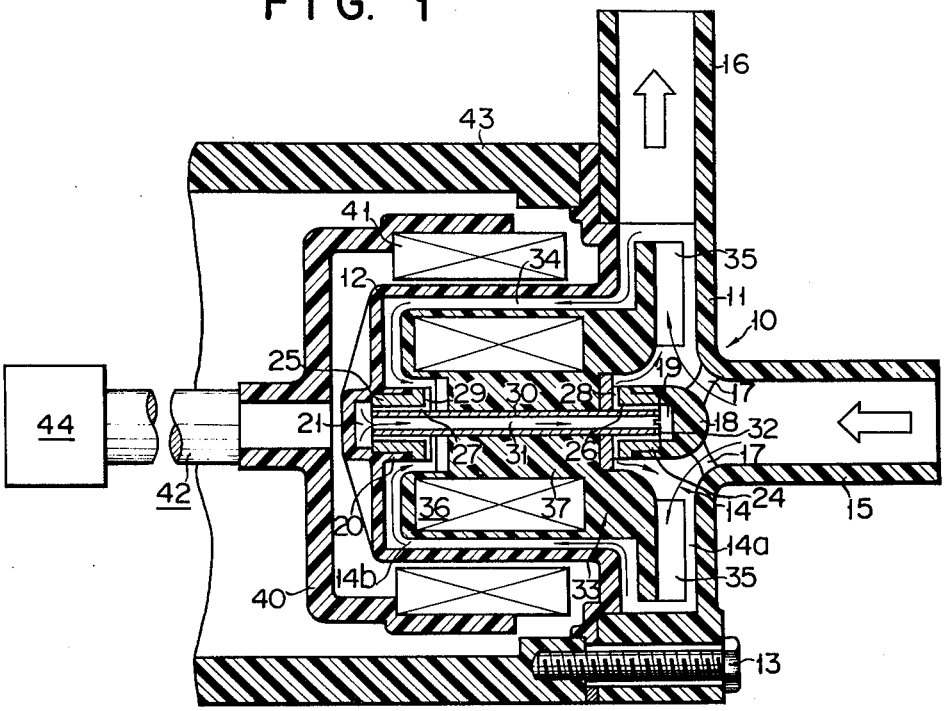
FIG. 1 is a longitudinal sectional view of a magnetically driven centrifugal pump according to an embodiment of this invention.
Figure 2:
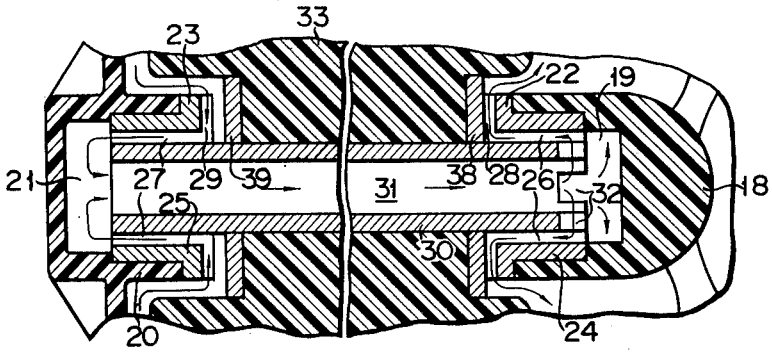
FIG. 2 is a fractional enlarged view of FIG. 1.

A magnetically driven centrifugal pump illustrated in FIGS. 1 to 4 is intended to pump a fluid such as water or chemical solution, and is provided with a casing 10 made of corrosion-resistant nonmetallic material such as plastics. The casing 10 consists of a front casing member 11 and a back casing member 12 fixed to said front casing member 11 by a screw 13. The two casing members 11, 12 are connected together in liquid tightness. Provided in the casing 10 is a pump chamber 14 which is formed of a relatively shallow larger diameter cylindrical portion **14*a* and a relatively deeper smaller diameter cylindrical portion 14*b*. Fitted to the larger diameter cylindrical portion 14a are a concentrically extending inlet pipe 15 and a radially extending outlet pipe 16. At the center of the larger diameter cylindrical portion 14a, a bearing holding member 18 is fixed to the inner walls of the front casing member 11 by means of a plurality of radially extending arms 17. The inlet side of the bearing holding member 18 is made spherical, and the outlet side thereof constitutes a cylindrical recess 19. A cylindrical hollow projection 20 is provided on the inner wall of the bottom portion of the back casing member 12 concentrically with said cylindrical recess 19. Said hollow projection 20 defines another cylindrical recess 21 within itself. Firmly fitted into the cylindrical recesses 19, 21 are bearing rings 24, 25 respectively which are made of polyfluoroethylene such as Teflon or carbon and provided with outer flanges 22, 23** (FIG. 2).

The inner walls of the bearing rings 24, 25 are provided with a plurality of axially extending grooves 26, 27 at a prescribed peripheral interval. The end faces of the outer flanges 22, 23 are provided with radially extending grooves 28, 29 communicating with the aforesaid grooves 26, 27. FIG. 3 shows the details of the bearing ring 25. The bearing rings 24, 25 jointly hold in a rotatable and slidable state a hollow supporting shaft 30 shorter than a space between the mutually facing bottom planes of the cylindrical recesses 19, 21 such that both ends of the supporting shaft 30 are always kept apart from the bottom planes of said recesses 19, 21. The supporting shaft 30 is made of, for example, suitable ceramic material and bored with an axially extending hole 31. That end face of the supporting shaft 30 located downstream of the through hole 31 is provided with a plurality of radially extending pumping grooves shown in detail in FIG. 4. According to this embodiment, the supporting shaft 30 has four pumping grooves arranged at an equal peripheral interval.

The supporting shaft 30 is fitted with a concentric impeller 33, which is set in place with a gap 34 defined between said impeller 33 and the inner wall of the casing 10. The impeller 33 comprises a plurality of radially extending open type impeller blades 35 received in the larger diameter cylindrical portion 14a of the pump chamber 14 and a body 37 which is disposed in the smaller diameter cylindrical portion 14b of said pump chamber 14 and in which a ring-shaped permanent magnet 36 is embedded. The magnet 36 is made of ferrite and has a plurality of N and S poles alternately arranged around the periphery. Those portions of the impeller 33 which face the outer flanges 22, 23 are fitted with stop rings 38, 39 made of, for example, ceramic material mainly consisting of aluminium oxide.

A cup-shaped rotatable actuating member 40 is provided outside of the back casing member 12 so as to concentrically surround said member 12. Fitted to the inner wall of the actuating member 40 is a ring-shaped permanent magnet 41, whose inner wall is set apart from the back casing member 12 at a prescribed space. The ring-shaped magnet 41 is formed of ferrite and has a plurality of N and S poles alternately arranged on the inner peripheral wall. The left end of the actuating member 40 (as viewed from FIG. 1) is fitted with a concentric drive shaft 42 which in turn is connected to a power source 44 such as an electric motor. A protective casing 43 is provided to surround the actuating member 40 by being fixed to the front and back casing members 11, 12 by the screw 13.

In the foregoing embodiment, the gap 34, the grooves 29, 27 of the bearing ring 25, the recess 21, the through hole 31 of the supporting shaft 30 and the grooves 26, 28 of the bearing ring 24 jointly constitute a passage for a cooling fluid.

Where, during operation, the actuating member 40, together with the ring-shaped magnet 41, is rotated by the drive shaft 42, then a magnetic force generated across the magnets 41, 36 turns round the impeller 36, causing a fluid to be carried, as is well known, from the inlet pipe 15 to the outlet pipe 16 by the action of the impeller blades 35. At this time, the discharge pressure P of the pump causes part of a fluid to pass through the gap 34, the grooves 29, 27 of the bearing ring 25 and the recess 21 finally into the through hole 31 of the supporting shaft 30, and thereafter to be brought to the front side of the impeller 33 through the recess 19 and the grooves 26, 28 of the bearing ring 24. The pumping grooves 32 centrifugally conduct the fluid outward in the radial direction defined by said pumping grooves 32, thereby forcefully delivering the fluid drawn through the penetrating hole 31 of the supporting shaft 30. Thus the fluid traveling through said hole 31 and the grooves 29, 26 of the bearing rings 25, 24 effectively absorbs friction heat generated in the interface between the supporting shaft 31 and bearing rings 25, 24.

Even where the discharge pressure P of the pump sharply falls for some reason or other, the cooling fluid continues to run through the passages by the action of the pumping grooves 32, so long as the impeller is kept rotating, thereby reliably preventing the shaft 30 from being seized or damaged.

There will now be described the hollow shaft 30a of FIG. 5 provided at one end face with four pumping grooves 32a which are modified to have a volute curve. In this case, the shaft 30a is chosen to rotate in the direction of the indicated arrow.

Figure 6:
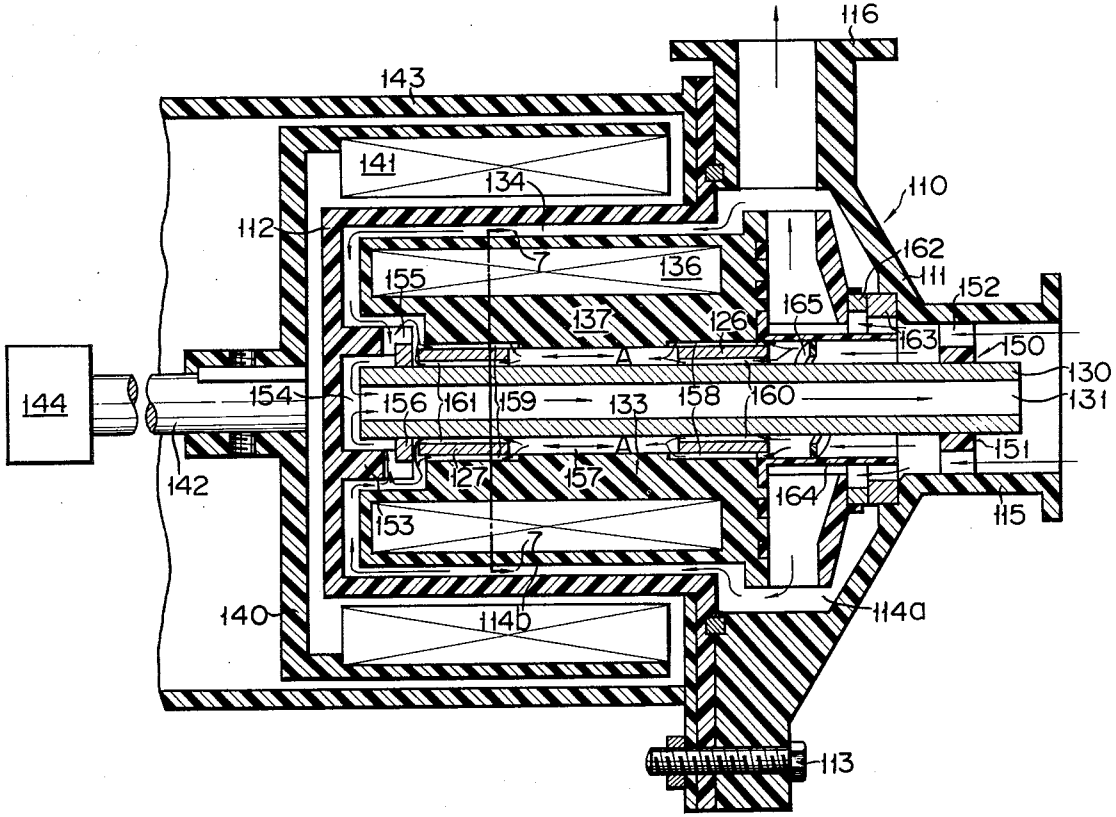
FIG. 6 is a longitudinal sectional view of a magnetically driven centrifugal pump according to another embodiment of the invention.

There will now be described by reference to FIGS. 6 and 7 a magnetically driven centrifugal pump according to another embodiment of the invention. This centrifugal pump comprises a casing 110 consisting of a front casing member 111 and a back casing member 112; inlet pipe 115, outlet pipe 116; actuating member 140; magnet 141; drive shaft 142; and protective casing 143. This embodiment has substantially the same construction as the preceding one, detailed description thereof being omitted. The hollow supporting shaft 130 is fixed to the inner wall of the casing 110, and the impeller 133 is made rotatable relative to the shaft 130. The inner wall of the inlet pipe 115 is fitted with an inner flange 150. The inner flange 150 has a plurality of small axial holes 152 bored near the periphery at an equal space. The back casing member 112 has a cylindrical projection 153 formed on the inner bottom plane. This projection has a recess 154 concentric with the larger diameter hole 151 of the inner flange 150. The end portion of the cylindrical projection 153 is provided with a plurality of radially extending grooves 155. A stop ring 156 prepared from ceramic material mainly consisting of aluminium oxide is fitted into the recess 154. The stop ring 156 is shorter than the grooves 155 and has a smaller inner diameter than the recess 154. A hollow supporting shaft 130 made of ceramic material mainly consisting of aluminium oxide is fixed at one end to the inner peripheral wall of the larger diameter hole 151 of the inner flange 150 and at the other end to the inner peripheral wall of the stop ring 156. The supporting shaft 130 is bored with an axially extending hole 131. Said other end of the shaft 130 is set apart from the inner bottom wall of the recess 154 at a prescribed space.

The impeller 133 is rotatably and slidably supported on the supporting shaft 130 by means of the bearing rings 126, 127. Namely, the body 137 of the impeller 133 is bored with an axially extending cylindrical hole 157 having a larger diameter than the outer diameter of the supporting shaft 130. The inner wall of said cylindrical hole 157 is provided with a plurality of grooves 158, 159 axially extending from the ends of te impeller 133. The outer peripheral walls of the bearing rings 126, 127 are firmly fitted into those portions of the inner peripheral wall of the cylindrical hole 157 which are disposed adjacent to the grooves 158, 159. The inner peripheral walls of the bearing rings 126, 127 are respectively provided with a plurality of grooves 160, 161 and engage the outer wall of the shaft 130 in a rotatable and slidable state. The mutually facing ends of the bearing rings 126, 127 terminate at a point slightly outside of the mutually facing ends of the grooves 158, 159. The left end of the bearing ring 127, as viewed from FIG. 6, axially projects ahead of the groove 159.

A ring-shaped ferrite magnet 136 is embedded around the outer periphery of the impeller body 137 like the ferrite magnet 36 of the preceding embodiment. One end face of the impeller body 137 is fitted with a plurality of closed type impeller blades 135. That side of the impeller blade member which faces the inlet pipe 115 is fitted with a stop ring 162 made of polyfluoroethylene such as Teflon or carbon. The inner wall of the front casing member 111 facing said stop ring 162 is fitted with another stop ring 163 prepared from ceramic material mainly consisting of aluminium oxide. The stop rings 156, 163 are so positioned as to limit the axial movement of the impeller 133 by being pressed against the bearing ring 127 and the stop ring 163, respectively.

The aforesaid end face of the impeller body 137 is further fitted with a cylindrical member 164 having a larger diameter than the supporting shaft 130. The free end of the cylindrical member 164 is received in the inlet pipe 115 more inward than the impeller blades 135. The inner wall of the cylindrical member 164 is fitted with a plurality of axial flow type blades 165 so as to conduct a fluid in the direction of the arrow indicated in FIG. 6. In the embodiment of FIG. 6, the route through which a cooling fluid travels comprises a first passage constituted by the gap 134 provided between the back casing member 112 and impeller 133, groove 155, recess 154 and passage 131, and a second passage defined by the grooves 158, 160, hole 157, grooves 159, 161, 155, recess 154 and duct 131.

There will now be described the operation of the embodiment of FIG. 6. Rotation of the outer magnet 141 causes a cooling fluid to be carried from the inlet pipe 115 to the outlet pipe 116 by the action of the impeller blades 135. At this time, part of the cooling fluid flows through the first and second passages by the discharge pressure so as to cool the supporting shaft 130 and bearing rings 126, 127. Particularly according to this embodiment, the supporting shaft 130 and bearing rings 126, 127 are very effectively cooled from within and without by the hole 130 and grooves 158, 159, 160, 161. Even where the discharge pressure sharply drops for some reason or other, the cooling fluid continues to run by the action of the axial flow type impeller blades 165, preventing the supporting shaft 130 from being seized or damaged.

What is claimed is:

1. A magnetically driven centrifugal pump comprising a casing defining a chamber therein and providing inlet and outlet means, an impeller rotatably arranged in the chamber and provided with a first magnet, an actuating member disposed outside of the casing so as to rotate concentrically with the impeller and provided with a second magnet, drive means for driving the actuating member to rotate the impeller by a magnetic force generated across the first and second magnets, first and second ring-shaped bearing members fixedly mounted on the inner wall of the casing behind and in front of the impeller, respectively, and a supporting shaft having a longitudinal hole extending therethrough and rotatably supported at its rear and front end portions on the inner peripheral walls of (by) said first and second bearing members, respectively, said impeller being fixed to the supporting shaft at a portion behind the front end portion thereof, said first and second bearing members respectively having first and second axial grooves in their inner peripheral walls (bearing surfaces), said first (and second) axial grooves communicating with the rear terminal opening (openings) of said longitudinal hole, (respectively,) said supporting shaft having at its front terminal surface at least one pumping groove which extends from the inner peripheral wall of the shaft to the outer peripheral wall thereof and has an opening opened at said outer peripheral wall, (connects the longitudinal hole of the shaft to the second axial groove of the second bearing member) the outer peripheral wall of the front end portion of the shaft being surrounded with the inner peripheral wall of the second bearing member so that, upon rotation of the shaft, the opening of the pumping groove intermittently communicates with the second axial grooves and means providing fluid communication between the outlet of the centrifugal pump and the first axial grooves.

2. A magnetically driven centrifugal pump according to claim 1, wherein the pumping groove extends straight in the radial direction of the supporting shaft.

3. A magnetically driven centrifugal pump according to claim 2, wherein each of said bearing members has an outer flange at the portion facing to the impeller, said outer flange being provided with radial grooves communicating with the axial grooves.

4. A magnetically driven centrifugal pump according to claim 1, wherein the inner wall of the casing is provided with a cylindrical hollow projection into which said first bearing member is fixedly fitted, said projection having a recess for connecting the first axial grooves of the first bearing member to the longitudinal hole of the shaft.

5. A magnetically driven centrifugal pump according to claim 4, further comprising a holding member for fixedly holding the second bearing member, said holding member having a plurality of arms fixed to the inner wall of the casing.

6. A magnetically driven centrifugal pump according to claim 1, wherein each of said bearing members is formed of a material selected from the group consisting of polyfluoroethylene and carbon.

7. A magnetically driven centrifugal pump according to claim 1, wherein the pumping groove extends in a volute curve.

* * * * *